US008294344B2

(12) United States Patent
Torii et al.

(10) Patent No.: US 8,294,344 B2
(45) Date of Patent: Oct. 23, 2012

(54) SPARK PLUG AND WELD METAL ZONE

(75) Inventors: Kazuyoshi Torii, Aichi (JP); Akira Suzuki, Aichi (JP); Naomichi Miyashita, Aichi (JP); Mamoru Musasa, Aichi (JP); Kenji Moritani, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 73 days.

(21) Appl. No.: 12/810,767

(22) PCT Filed: Dec. 25, 2008

(86) PCT No.: PCT/JP2008/073541

§ 371 (c)(1),
(2), (4) Date: Sep. 21, 2010

(87) PCT Pub. No.: WO2009/084565

PCT Pub. Date: Jul. 9, 2009

(65) Prior Publication Data

US 2011/0025185 A1 Feb. 3, 2011

(30) Foreign Application Priority Data

Dec. 27, 2007 (JP) ..... 2007-338085

(51) Int. Cl.
*H01T 13/20* (2006.01)

(52) U.S. Cl. ..... 313/141; 313/118

(58) Field of Classification Search ..... None
See application file for complete search history.

(56) References Cited

U.S. PATENT DOCUMENTS

| | | | | |
|---|---|---|---|---|
| 5,722,896 | A | 3/1998 | Beagley et al. | |
| 6,621,198 | B2 * | 9/2003 | Kanao et al. | 313/141 |
| 7,083,488 | B2 * | 8/2006 | Taniguchi et al. | 445/7 |
| 7,084,558 | B2 * | 8/2006 | Teramura et al. | 313/141 |
| 7,557,495 | B2 * | 7/2009 | Tinwell | 313/143 |
| 8,044,562 | B2 * | 10/2011 | Musasa et al. | 313/141 |

(Continued)

FOREIGN PATENT DOCUMENTS

JP 57-163975 A 10/1982

(Continued)

OTHER PUBLICATIONS

Machine translation of Applicant cited JP 2004-134209 A, published Apr. 30, 2004.*

(Continued)

*Primary Examiner* — Anh Mai
*Assistant Examiner* — Britt D Hanley
(74) *Attorney, Agent, or Firm* — Sughrue Mion, PLLC

(57) ABSTRACT

A spark member (70) is formed by joining a noble metal member (71) and an intermediate member (75) and is provided in a spark discharge gap between a center electrode and a ground electrode (30). A bottom surface (80) of the intermediate member (75) is resistance-welded to an inner surface (33) of the ground electrode (30), and a weld metal zone (73) is formed in the region of joint therebetween. As viewed on the section of the spark member (70) which contains a centerline (Q), the weld metal zone (73) is reliably formed within the range of the length (D) of a columnar portion (76) as measured along a direction orthogonal to the projecting direction of the spark member (70) and has a length (d) of at least 0.1 times (10% of) the length (D).

9 Claims, 5 Drawing Sheets

U.S. PATENT DOCUMENTS

| | | | | |
|---|---|---|---|---|
| 8,052,495 | B2 * | 11/2011 | Kato et al. | 445/7 |
| 8,098,004 | B2 * | 1/2012 | Kato et al. | 313/141 |
| 2004/0129683 | A1 | 7/2004 | Torii et al. | |
| 2007/0128964 | A1 * | 6/2007 | Hori | 445/7 |
| 2008/0238282 | A1 | 10/2008 | Kato et al. | |
| 2009/0261075 | A1 * | 10/2009 | Aoyama et al. | 219/93 |
| 2010/0264802 | A1 * | 10/2010 | Tanaka et al. | 313/141 |
| 2011/0043093 | A1 * | 2/2011 | Nunome | 313/141 |

FOREIGN PATENT DOCUMENTS

| | | | |
|---|---|---|---|
| JP | 06-235415 | A | 8/1994 |
| JP | 09-106879 | A | 4/1997 |
| JP | 2004-134209 | A | 4/2004 |
| JP | 2004-158220 | A | 6/2004 |
| JP | 2005-150011 | A | 6/2005 |
| JP | 2007-218419 | A | 8/2007 |
| JP | 2008-243713 | A | 10/2008 |

OTHER PUBLICATIONS

Machine translation of Applicant cited JP 2007-218419 A, published Aug. 30, 2007.*

Machine translation of Applicant cited JP 2005-150011 A, published Jun. 9, 2005.*

* cited by examiner

[FIG. 1]
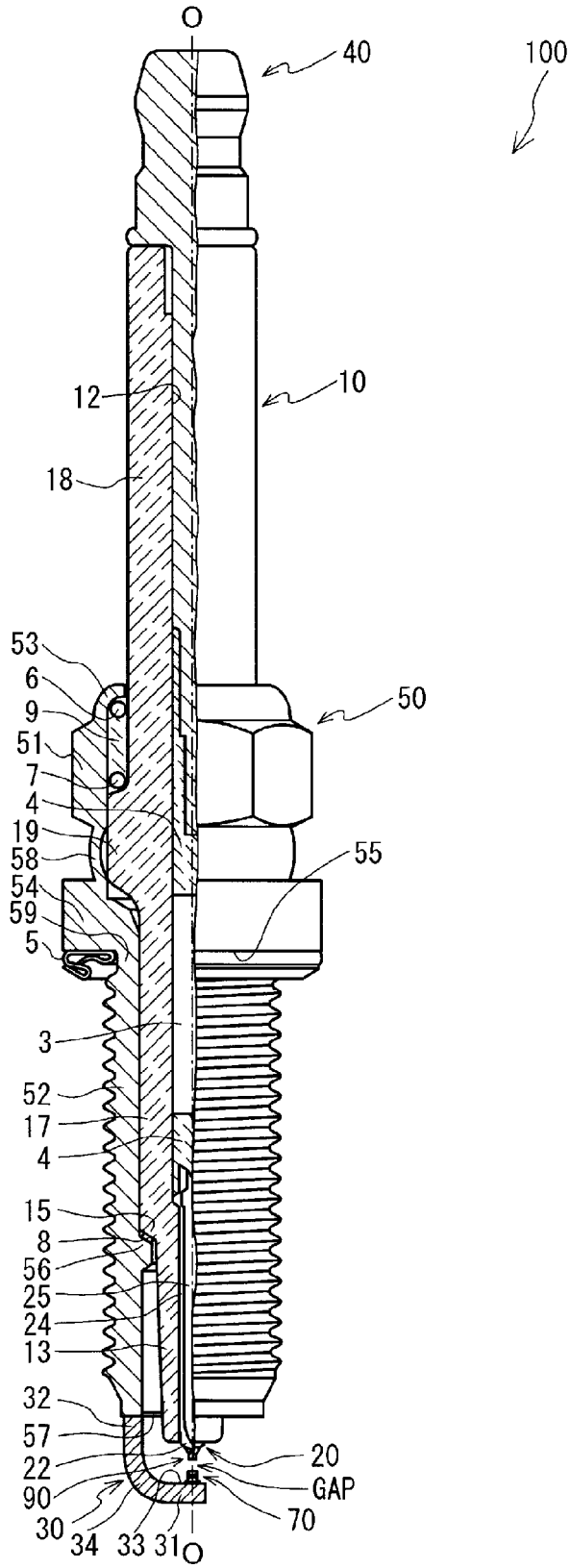

[FIG. 2]
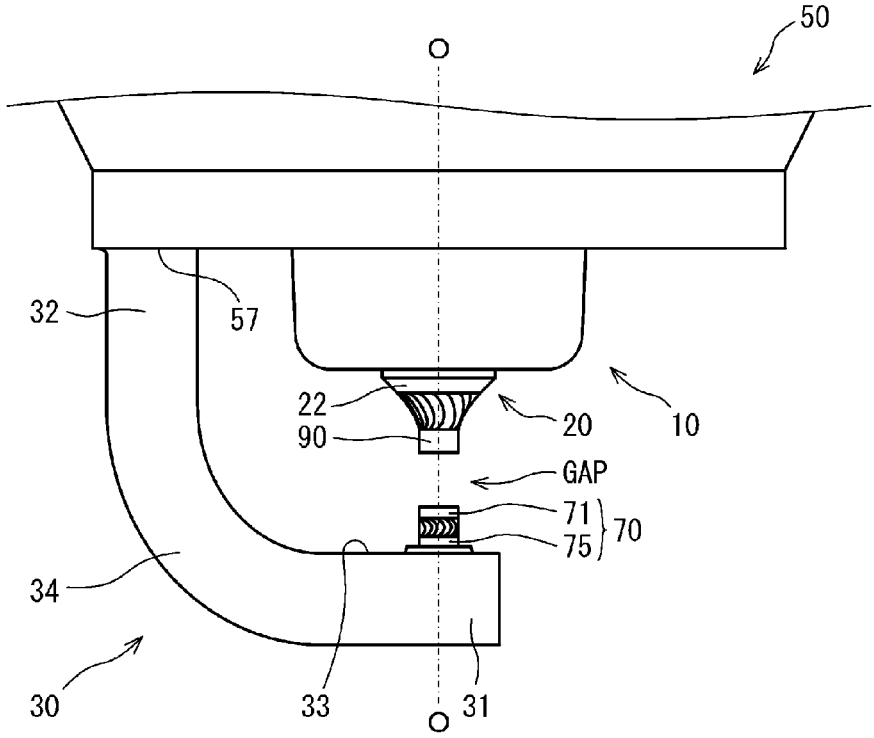

[FIG. 3]
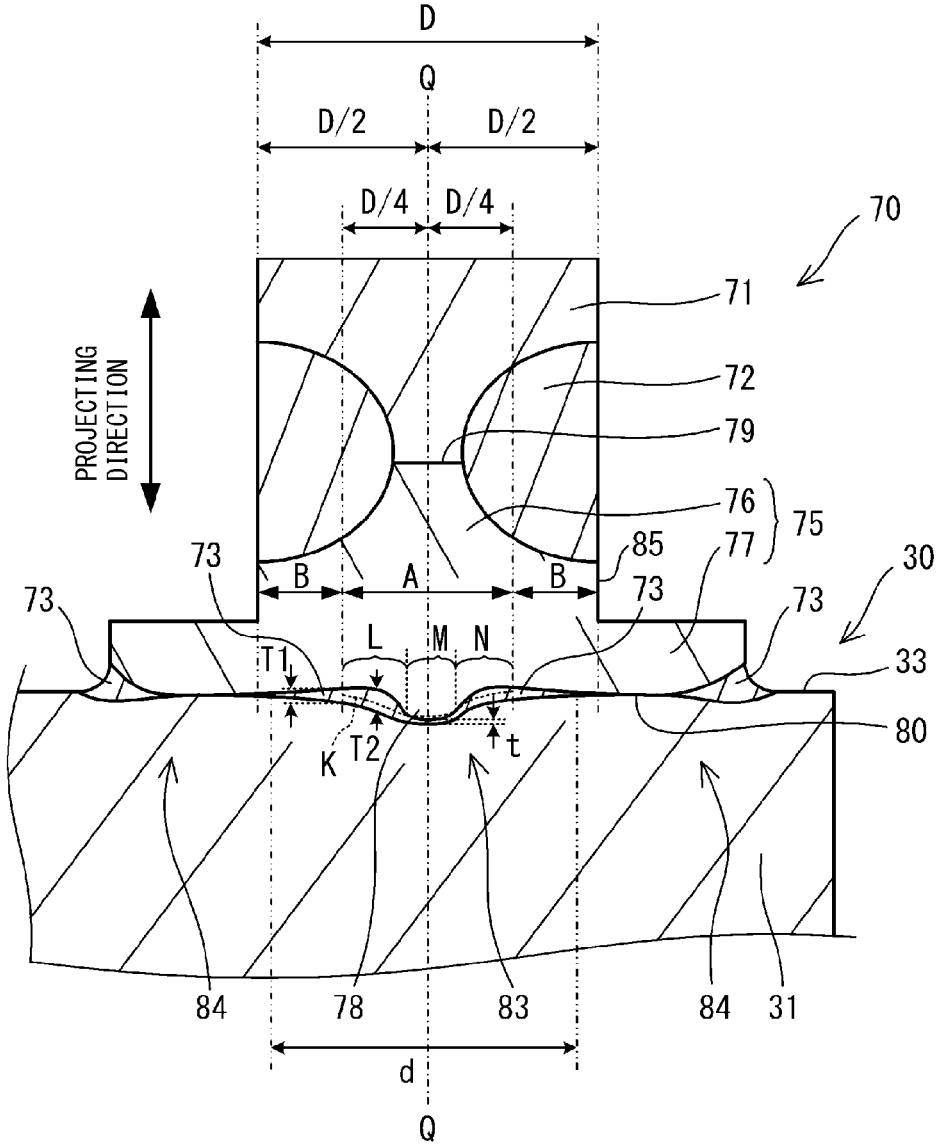

[FIG. 4]
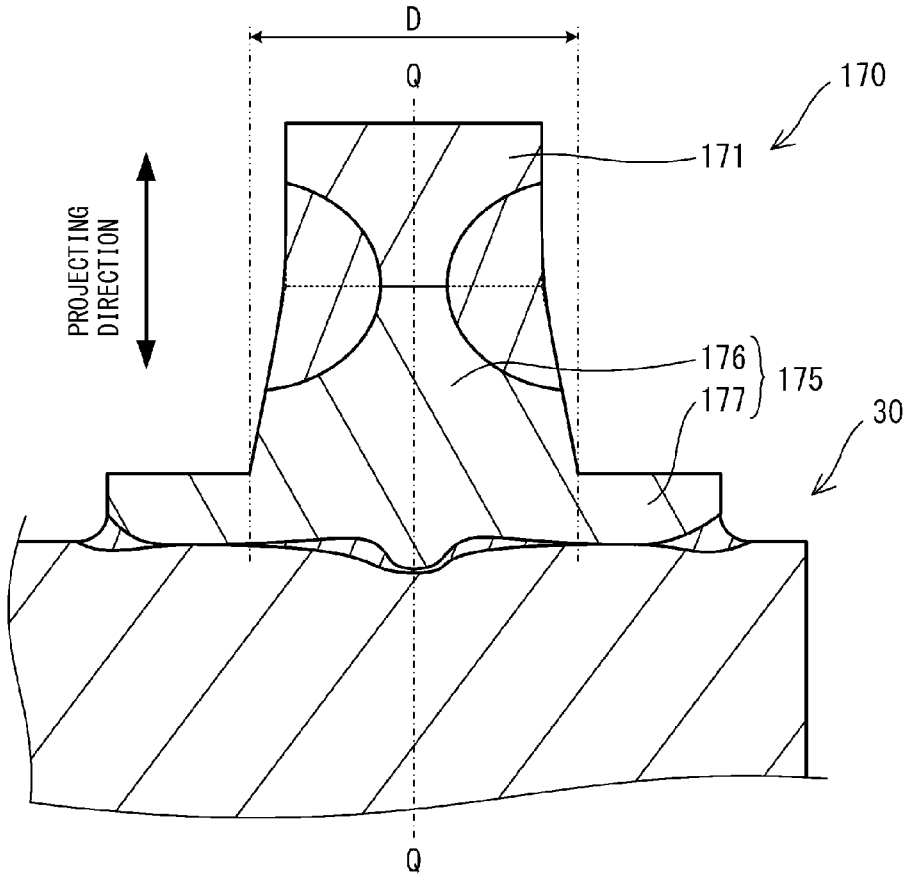

[FIG. 5]
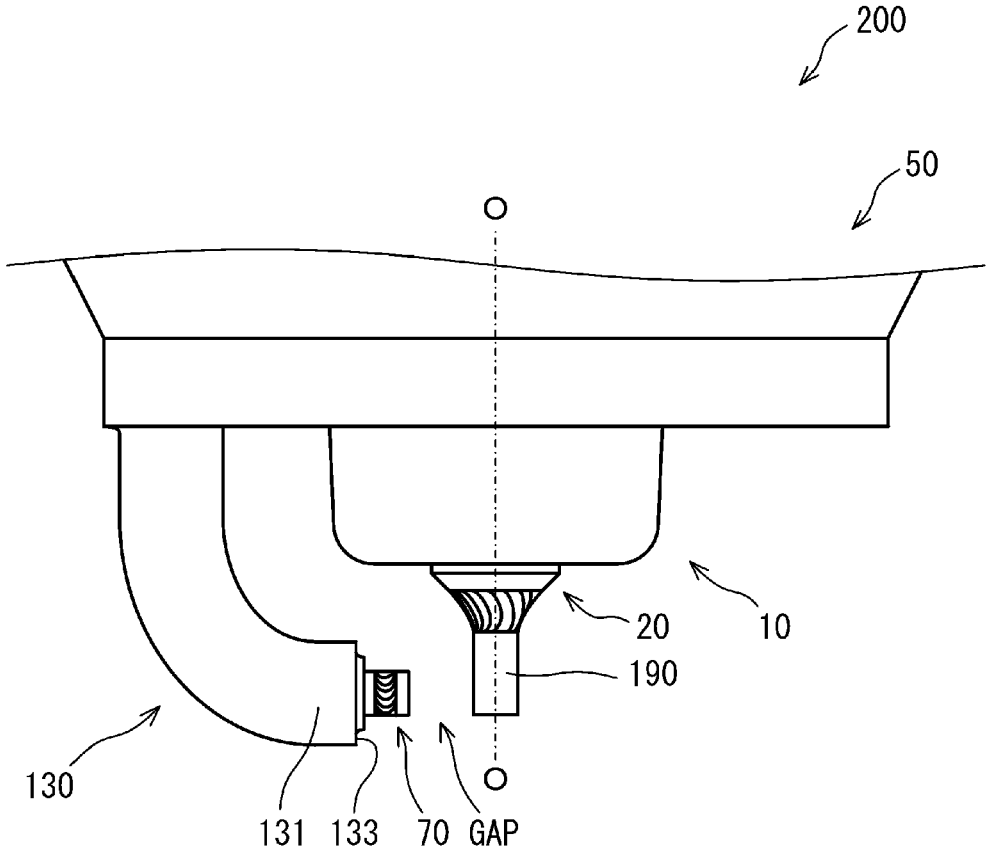

SPARK PLUG AND WELD METAL ZONE

CROSS REFERENCE TO RELATED APPLICATIONS

This application is a National Stage of International Application No. PCT/JP2008/073541 filed Dec. 25, 2008, claiming priority based on Japanese Patent Application No. 2007-338085, filed Dec. 27, 2007, the contents of all of which are incorporated herein by reference in their entirety.

TECHNICAL FIELD

The present invention relates to a spark plug in which a ground electrode has a needlelike spark member that, in cooperation with a center electrode, forms a spark discharge gap.

BACKGROUND ART

There is known a spark plug in which a needlelike spark member is provided on an inner surface (one surface) of the distal end portion of a ground electrode which faces a center electrode, so as to form a spark discharge gap between the spark member and the center electrode. As compared with a conventional spark plug, in the spark plug having such a needlelike spark member, the ground electrode can be located more distant from the spark discharge gap. Accordingly, a flame nucleus to be formed in the spark discharge gap is unlikely to come into contact with the ground electrode in the initial stage of its growth. Thus, since a so-called flame-extinguishing action; i.e., hindrance of growth of a flame nucleus due to removal of heat caused by contact of the flame nucleus with the ground electrode, can be weakened, the ignition performance of the spark plug can be improved.

There is known a spark plug (refer to, for example, Patent Document 1) in which such a spark member (chip-attached intermediate member) is composed of a noble metal member (chip) and an intermediate member, which is joined to a ground electrode. According to Patent Document 1, a bottom surface (second surface) of the intermediate member which is joined to the ground electrode is rendered wider than a top surface (first surface) of the intermediate member which is joined to the noble metal, whereby the area of welding is expanded for enhancement of joining strength. By virtue of this, the spark member and the ground electrode can be joined by means of generally practiced resistance welding.

Meanwhile, laser welding is generally employed for joining the noble metal member and the intermediate member. A weld metal zone formed in a joint of the noble metal member and the intermediate member is generally lower in strength than the noble metal member and the intermediate member. Thus, in the course of resistance welding of the spark member to the ground electrode, application of a pressing force to the intermediate member via the noble metal member for bringing the junction surfaces of the intermediate member and the ground electrode in close contact with each other involves the risk of deformation of the weld metal zone stemming from increase in internal stress of the weld metal zone. Also, upon subjection to thermal load associated with use of the spark plug, the residual internal stress may lead to cracking, separation, or the like. In order to prevent such a problem, as disclosed in Patent Document 1, a pressing force is applied to a flange portion which is provided for implementing a bottom surface wider than the top surface, so as to avoid applying the pressing force to the noble metal member. In this state, while the bottom surface of the intermediate member and the inner surface of the ground electrode are brought in close contact with each other, resistance welding is carried out.

Patent Document 1: Japanese Patent Application Laid-Open (kokai) No. 2004-134209

DISCLOSURE OF THE INVENTION

However, as in the case of Patent Document 1, when a pressing force is applied to the flange portion of the intermediate member by use of a tubular jig or the like in the course of resistance welding, a large pressing force is exerted on the inner surface of the ground electrode at a peripheral portion of the bottom surface of the intermediate member, whereas a small pressing force is exerted on the inner surface of the ground electrode at a central portion of the bottom surface. Thus, when welding current is applied through the jig, welding current is apt to flow at the peripheral portion of the bottom surface in close contact with the inner surface of the ground electrode. Accordingly, a weld metal zone is formed in such a manner as to propagate starting from the peripheral portion of the bottom surface. Under certain welding conditions (magnitude of welding current, time of application of welding current, etc.), there is the risk of failure to form a weld metal zone in a certain region of the central portion of the bottom surface located away from the peripheral portion of the bottom surface. Particularly, in the case where the flange portion deflects at the time of application of pressing force due to low rigidity thereof, the central portion of the bottom surface may fail to come into contact with the inner surface of the ground electrode, with resultant formation of a gap therebetween. When oxide scale which progresses inward from the peripheral portion reaches such a region where a weld metal zone is not formed, the oxide scale expands, potentially causing the occurrence of cracking, separation, or the like.

The present invention has been conceived to solve the above-mentioned problem. An object of the present invention is to provide a spark plug in which an intermediate member integral with a noble metal member is resistance-welded to a ground electrode such that a weld metal zone is reliably formed within a region of the bottom surface of the intermediate member, the region corresponding to a columnar portion of the intermediate member projected on the bottom surface of the intermediate member.

According to a mode of the present invention, there is provided a spark plug comprising a center electrode; an insulator which has an axial hole extending along an axial direction and holds the center electrode in the axial hole; a metallic shell which circumferentially surrounds and holds the insulator; a ground electrode whose one end portion is joined to the metallic shell and which is bent such that one surface of the other end portion thereof faces a front end portion of the center electrode so as to form a spark discharge gap therebetween; and a spark member which is provided on the one surface of the other end portion of the ground electrode at a position corresponding to the spark discharge gap, projects from the one surface toward the center electrode, and is configured such that a noble metal member disposed on a side toward the center electrode with respect to a projecting direction thereof and an intermediate member disposed between the noble metal member and the ground electrode are joined to each other. The intermediate member of the spark member has a columnar portion including a top surface joined to the noble metal member and extending in the projecting direction, and a flange portion including a bottom surface joined to the ground electrode and assuming such a flange-like shape as to be radially expanded as compared with the columnar portion. The one surface of the ground electrode and the bottom surface of the intermediate member are resistance-welded to each other such that a weld metal zone is formed between the one surface and the bottom surface. As viewed on a section of the intermediate member and the ground electrode taken along a plane which contains a centerline of the spark member extending along the projecting direction of the spark member, a relation $d \geqq 0.1D$ is satisfied, where d is a length occupied in a direction orthogonal to the projecting direction by a portion of the weld metal zone formed inside an imaginary plane which passes through a boundary between the columnar portion and the flange portion and extends along the projecting direction, and D is a length of the columnar portion as measured along a direction orthogonal to the projecting direction.

In the present mode, the spark member configured such that the noble metal member and the intermediate member are joined to each other is joined to the ground electrode as follows: the bottom surface of the intermediate member is resistance-welded to one surface of the ground electrode. As viewed on the section of the spark member, the weld metal zone formed in the region of joint between the spark member and the ground electrode is reliably formed within the range of the length D of the columnar portion as measured along the direction orthogonal to the projecting direction of the spark member (in other words, within the range of the columnar portion projected on the bottom surface of the intermediate member); thus, the strength of joining the spark member and the ground electrode can be enhanced. When the length d of the weld metal zone is at least 0.1 times (10% of) the length D of the columnar portion; i.e., the relation $d \geqq 0.1D$ is satisfied, a sufficient joining strength to restrain the occurrence of separation or the like and the progress of oxide scale can be exhibited in the course of normal use of the spark plug.

When $d<0.1D$, with respect to the direction orthogonal to the projecting direction of the spark member, a region where the weld metal zone is not formed accounts for 90% or more of the interface between the spark member and the ground electrode. That is, the presence of the weld metal zone is sparse within the range of the length D of the columnar portion on the bottom surface of the intermediate member; therefore, maintaining a joined state of the spark member and the ground electrode is difficult. An oxide scale which progresses from the outside toward the inside of the region of joint between the spark member and the ground electrode is apt to progress rapidly when the weld metal zone is sparsely present, so that separation, cracking, or the like may be apt to occur in the weld metal zone.

In the present mode, as viewed on the section, the weld metal zone may satisfy a relation $d \geqq 0.4D$. Further, at least a portion of the weld metal zone may be formed within a range between opposite positions each located D/4 away from the centerline in a direction orthogonal to the projecting direction.

In order to further enhance joining strength so as to sufficiently maintain a joined state of the spark member and the ground electrode even when the spark plug is used in a severer environment, it is good practice that the length d of the weld metal zone is at least 0.4 times (40% of) the length D of the columnar portion; i.e., the relation $d \geqq 0.4D$ is satisfied. Further, it is good practice that at least a portion of the weld metal zone is present within the range between opposite positions each located D/4 away from the centerline of the spark member in the direction orthogonal to the projecting direction of the spark member. Through employment of these practices, the presence of the weld metal zone can be rendered denser within the range of the length D of the columnar portion on the bottom surface of the intermediate member. Then, even when the spark plug is exposed to a severer environment, the progress of oxide scale can be restrained, so that the occurrence of separation, cracking, or the like can be prevented.

In the present mode, as viewed on the section, a relation $t<T1$ may be satisfied, where t is a thickness of a thinnest portion of the weld metal zone as measured in the projecting direction within the range between opposite positions each located D/4 away from the centerline in the direction orthogonal to the projecting direction, and T1 is a thickness of a thickest portion of the weld metal zone as measured in the projecting direction within opposite ranges each between a position located D/4 away from the centerline in a direction orthogonal to the projecting direction and a corresponding position located D/2 away from the centerline in the direction orthogonal to the projecting direction.

The spark member disposed in the spark discharge gap is exposed to high temperature in the course of spark discharges. In order to lower thermal load exerted on the noble metal member, it is desirable to quickly release heat received at the spark portion toward the ground electrode for prevention of accumulation of heat at the spark member. For quick release of heat, it is desirable to reduce the thickness of the weld metal zone (thickness along the projecting direction of the spark member), which lowers thermal conductivity, to thereby enable smooth flow of heat from the spark member to the ground electrode. In the present mode, when the relation $t<T1$ is satisfied, within the range between opposite positions each located D/4 away from the centerline of the spark member, heat can be smoothly conducted from the spark member to the ground electrode, whereby resistance to spark-induced erosion of the noble metal member can be enhanced. Also, since thermal load exerted on the weld metal zone can be lowered, the progress of oxide scale in the weld metal zone can be restrained, whereby the strength of joining the spark member and the ground electrode can be enhanced.

In the present mode, when T2 represents a thickness of a thickest portion of the weld metal zone formed within the range between opposite positions each located D/4 away from the centerline in the direction orthogonal to the projecting direction, a first thick-layer portion having a thickness greater than a middle thickness $(T2+t)/2$ of the thickness T2 and the thickness t, a thin-layer portion having a thickness smaller than the middle thickness $(T2+t)/2$, and a second thick-layer portion having a thickness greater than the middle thickness $(T2+t)/2$ and different from the first thick-layer portion may be continuously arranged in this order in the direction orthogonal to the projecting direction. Further, a portion of the weld metal zone having the thickness t may be present at the thin-layer portion.

This configurational feature means that the thickness of the weld metal zone formed within the range between opposite positions each located D/4 away from the centerline of the spark member is irregular, and heat can be smoothly conducted from the spark member to the ground electrode via the thin-layer portion. In order to sequentially arrange the first thick-layer portion, the thin-layer portion, and the second thick-layer portion, the weld metal zone is formed by resistance welding as follows. Before welding, a projecting portion is formed in such a manner as to project from the bottom surface of the intermediate member. In the course of resistance welding, before the bottom surface of the intermediate member comes into contact with one surface of the ground electrode, the projecting portion is brought into contact with the one surface of the ground electrode and is fused, thereby growing a weld metal zone around the projecting portion. That is, the projecting portion makes the thickness of the weld metal zone irregular. Through formation of the weld metal zone in such a form within the range between opposite positions each located D/4 away from the centerline of the spark member, the presence of the weld metal zone can be rendered dense within the range of the length D of the columnar portion on the bottom surface of the intermediate member, whereby the joining strength can be enhanced. Further, heat can be smoothly conducted from the spark member via the thin-layer portion, whereby resistance to spark-induced erosion of the noble metal member can be enhanced. Also, since thermal load exerted on the weld metal zone can be lowered, the joining strength can be further enhanced.

BRIEF DESCRIPTION OF THE DRAWINGS

[FIG. 1] Partially sectional view of a spark plug 100.

[FIG. 2] Enlarged sectional view showing a spark discharge gap GAP and its peripheral region of the spark plug 100.

[FIG. 3] Sectional view showing a spark member 70 according to a modification and its peripheral region.

[FIG. 4] Sectional view showing a modified spark member 170.

[FIG. 5] Enlarged sectional view showing the spark discharge gap GAP and its peripheral region of a spark plug 200 according to a modification.

BEST MODE FOR CARRYING OUT THE INVENTION

An embodiment of a spark plug of the present invention will next be described with reference to the drawings. First, referring to FIGS. 1 to 3, the structure of an example spark plug 100 will be described. In the following description, the direction of an axis O of the spark plug 100 in FIGS. 1 and 2 is referred to as the vertical direction, and the lower side of the spark plug 100 in the drawings is referred to as the front side of the spark plug 100, and the upper side as the rear side of the spark plug 100.

As shown in FIG. 1, schematically speaking, the spark plug 100 has the following structure: a center electrode 20 is held on the front side in an axial hole 12 of an insulator 10; a metal terminal 40 is held on the rear side in the axial hole 12; and a metallic shell 50 circumferentially surrounds and holds the insulator 10. A ground electrode 30 is joined to a front end surface 57 of the metallic shell 50 and is bent such that the other end portion (distal end portion 31) of the ground electrode 30 faces a front end portion 22 of the center electrode 20 so as to form a spark discharge gap GAP between the ground electrode 30 and the center electrode 20.

First, the insulator 10 of the spark plug 100 will be described. As is well known, the insulator 10 is formed through firing of alumina or the like and has a tubular shape such that the axial hole 12 extends at the center along the direction of the axis O. The insulator 10 has a flange portion 19 formed substantially at the center with respect to the direction of the axis O and having the largest outside diameter, and a rear trunk portion 18 located rearward (on the upper side in FIG. 1) of the flange portion 19. The insulator 10 has a front trunk portion 17 located frontward (on the lower side in FIG. 1) of the flange portion 19 and having an outside diameter smaller than that of the rear trunk portion 18, and a leg portion 13 located frontward of the front trunk portion 17 and having an outside diameter smaller than that of the front trunk portion 17. The leg portion 13 is reduced in diameter toward its front end and is exposed to the interior of a combustion chamber when the spark plug 100 is mounted to an engine head (not shown) of an internal combustion engine. A step portion 15 is formed in a stepped manner between the leg portion 13 and the front trunk portion 17.

Next, the center electrode 20 will be described. The center electrode 20 is a rodlike electrode having the following structure: a core material 25 is embedded in a base material 24; the core material 25 is copper, which has excellent thermal conductivity, or an alloy which predominantly contains copper; and the base material 24 is Ni or an alloy which predominantly contains Ni, such as INCONEL (trademark) 600 or 601. The center electrode 20 is held on the front side in the axial hole 12 of the insulator 10, and, as shown in FIG. 2, the front end portion 22 projects frontward from the front end of the insulator 10. The front end portion 22 of the center electrode 20 is formed such that its diameter reduces toward its front end. An electrode chip 90 of a noble metal is joined to the front end surface of the front end portion 22 for improving resistance to spark-induced erosion.

As shown in FIG. 1, the center electrode 20 is electrically connected to the metal terminal 40 located rearward (on the upper side in FIG. 1) via an electrically conductive seal member 4 and a ceramic resistor 3, which extend in the axial hole 12 along the direction of the axis O. During use of the spark plug 100, a high-voltage cable (not shown) is connected to the metal terminal 40 via a plug cap (not shown) for application of high voltage.

Next, the metallic shell 50 will be described. The metallic shell 50 has a cylindrical shape and is adapted to fix the spark plug 100 to an engine head (not shown) of an internal combustion engine. The metallic shell 50 holds the insulator 10 therein in such a manner as to surround a region of the insulator 10 extending from a portion of the rear trunk portion 18 to the leg portion 13. The metallic shell 50 is formed from low-carbon steel and includes a tool engagement portion 51 with which an unillustrated spark plug wrench is engaged, and a mounting threaded portion 52 which is threadingly engaged with a mounting hole (not shown) in the engine head.

The metallic shell 50 has a flange-like seal portion 54 formed between the tool engagement portion 51 and the mounting threaded portion 52. An annular gasket 5 formed by bending a plate member is fitted to a screw neck portion 59 located between the mounting threaded portion 52 and the seal portion 54. When the spark plug 100 is mounted to a mounting hole (not shown) in the engine head, the gasket 5 is crushed between a seat 55 of the seal portion 54 and the periphery around an opening of the mounting hole and provides a seal therebetween, thereby preventing leakage from inside the engine via the mounting hole.

The metallic shell 50 has a thin-walled crimp portion 53 located rearward of the tool engagement portion 51, and a similarly thin-walled buckle portion 58 located between the seal portion 54 and the tool engagement portion 51. Annular ring members 6 and 7 intervene between the inner circumferential surface of a portion of the metallic shell 50 extending between the tool engagement portion 51 and the crimp portion 53 and the outer circumferential surface of the rear trunk portion 18 of the insulator 10, and a space between the ring members 6 and 7 is filled with powder of talc 9. When the crimp portion 53 is crimped in such a manner as to be bent inward, the insulator 10 is pressed frontward in the metallic shell 50 via the ring members 6 and 7 and the talc 9. Accordingly, the step portion 15 of the insulator 10 is supported via an annular sheet packing 8 by a step portion 56 formed on the inner circumference of the metallic shell 50 at a position corresponding to the mounting threaded portion 52, whereby the metallic shell 50 and the insulator 10 are united together. At this time, the sheet packing 8 maintains gas-tightness of the junction between the metallic shell 50 and the insulator 10, thereby preventing outflow of combustion gas. The buckle portion 58 is configured to be deformed outwardly as a result of application of compressive force in a crimping process, thereby increasing the stroke of compression of the talc 9 along the direction of the axis O and thus enhancing gas-tightness of the interior of the metallic shell 50.

Next, the ground electrode 30 will be described. The ground electrode 30 is a rodlike electrode having a rectangular cross section and is formed from Ni or an alloy which predominantly contains Ni, such as INCONEL (trademark) 600 or 601, as in the case of the center electrode 20. As shown in FIG. 2, the ground electrode 30 is joined, at its one end portion (proximal end portion 32), to the front end surface 57 of the metallic shell 50; extends along the direction of the axis O; and is bent at its bend portion 34 such that its one surface (inner surface 33) faces, at its other end portion (distal end portion 31), the front end portion 22 of the center electrode 20. The spark discharge gap GAP is formed between the distal end portion 31 of the ground electrode 30 and the front end portion 22 of the center electrode 20.

The ground electrode 30 has a spark member 70 which is provided on the inner surface 33 at the distal end portion 31 at a position corresponding to the spark discharge gap GAP and which projects in a needlelike manner from the inner surface 33 toward the front end portion 22 of the center electrode 20. The spark member 70 is composed of an intermediate member 75 and a noble metal member 71, which are overlaid on each other in the direction of projection from the ground electrode 30 (in the present embodiment, in the direction of the axis O) and are joined together.

As shown in FIG. 3, the noble metal member 71 is formed from a member which predominantly contains a noble metal having high resistance to spark-induced erosion, and has a circular columnar shape. The noble metal member 71 is disposed on the center electrode 20 side of the intermediate member 75 (see FIG. 2) with respect to the projecting direction of the spark member 70 and is joined to a top surface 79 of the intermediate member 75. The intermediate member 75 and the noble metal member 71 are joined together by means of conducting laser welding (or electron beam welding) such that a welding beam is aimed at a junction surface (interface) therebetween. A weld metal zone 72, in which components of the intermediate member 75 and the noble metal member 71 are fused and mixed, is formed in a region of welding between the intermediate member 75 and the noble metal member 71.

The intermediate member 75 is formed from an Ni alloy which predominantly contains Ni, and has a columnar portion 76 which extends along the direction of projection of the intermediate member 75 from the ground electrode 30, and a flange portion 77 assuming such a flange-like shape as to be radially expanded as compared with the columnar portion 76. The flange portion 77 includes a bottom surface 80 which is joined to the inner surface 33 of the ground electrode 30, and is provided at one end of the columnar portion 76 with respect to the projecting direction of the columnar portion 76. The bottom surface 80 and the inner surface 33 are resistance-welded together, and a noble metal zone 73, in which components of the intermediate member 75 and components of the ground electrode 30 are mixed, is formed in a region of welding thereof. The weld metal zone 73 is of a dendritic structure, a marble-like structure, a mixed structure thereof, or a like metallic structure.

In the present embodiment, the weld metal zone 73 is formed rather thick in the projecting direction in the vicinity of a peripheral portion 84 of the bottom surface 80. As can be seen in the drawing, the intermediate member 75 has a projection 78 which is formed approximately at a central portion 83 of the bottom surface 80 and projects from the bottom surface 80, and the weld metal zone 73 which is rather thick is also formed around the projection 78. The projecting end of the projection 78 is located in close proximity to or in close contact with the ground electrode 30. By virtue of the presence of the projection 78, the weld metal zone 73 includes a portion whose thickness with respect to the projecting direction of the spark member 70 is smaller than that of a surrounding portion. In this manner, the weld metal zones 73 dot in the junction between the bottom surface 80 of the intermediate member 75 and the inner surface 33 of the ground electrode 30. However, this is an example. Under certain resistance-welding conditions, the weld metal zone 73 may be formed over the entire bottom surface 80 or may not be formed at the peripheral portion 84. However, in the present embodiment, the weld metal zone 73 is reliably formed at and around the central portion 83. This will be described later.

By virtue of provision of the spark member 70 composed of the intermediate member 75 and the noble metal member 71 in the spark discharge gap GAP as shown in FIG. 2, at the time of spark discharge, spark discharge is performed between the electrode chip 90 of the center electrode 20 and the noble metal member 71 of the spark member 70. The spark discharge gap GAP refers to a region where spark discharge is performed between the center electrode 20 and the ground electrode 30. When the electrode chip 90 and the spark member 70 are provided on the center electrode 20 and the ground electrode 30, respectively, as in the case of the present embodiment, spark discharge is performed between the electrode chip 90 and the spark member 70. Thus, in the narrow sense, a gap between the electrode chip 90 and the spark member 70 may be called the spark discharge gap GAP.

In the thus-configured spark plug 100, in the process of manufacture, when the spark member 70 and the ground electrode 30 shown in FIG. 3 are to be resistance-welded, the spark member 70 is pressed against the ground electrode 30, and thus the bottom surface 80 of the intermediate member 75 is brought into contact with the inner surface 33 of the ground electrode 30. In this condition, welding current is applied between the intermediate member 75 and the ground electrode 30. Then, heat generated in association with contact resistance between the bottom surface 80 and the inner surface 33 melts the junction surfaces of the intermediate member 75 and the ground electrode 30, thereby forming the weld metal zone 73 in which components of the intermediate member 75 and the ground electrode 30 are mixed. In the process of resistance welding, in order to prevent application of stress to the weld metal zone 72 between the noble metal member 71 and the intermediate member 75 in association with pressing of the intermediate member 75 via the noble metal member 71, the flange portion 77 is pressed from a side opposite the bottom surface 80, thereby carrying out pressing of the spark member 70. This procedure lowers contact resistance between the bottom surface 80 and the inner surface 33 in the vicinity of the peripheral portion 84 and thus makes it easier for the welding current to flow, resulting in easier formation of the weld metal zone 73 in the vicinity of the peripheral portion 84.

Further, in the present embodiment, before joining, the intermediate member 75 has a projecting portion (not shown) which is to become the projection 78 and which projects from the bottom surface 80 of the intermediate member 75 approximately at the central portion 83 of the bottom surface 80. When the spark member 70 is pressed in the course of resistance welding, first, the projecting portion comes into contact with the inner surface 33 of the ground electrode 30. Heat generated in association with contact resistance between the projecting portion and the inner surface 33 melts the projecting portion, and the bottom surface 80 gradually approaches the inner surface 33. When the peripheral portion 84 comes into contact with the inner surface 33, a sufficiently large weld metal zone 73 is formed at and around the central portion 83 of the bottom surface 80. That is, the projection 78 appearing in FIG. 3 is a trace of the fused projecting portion. In order to reliably form the weld metal zone 73 at and around the central portion 83 so as to reliably enhance the strength of joining the spark member 70 and the ground electrode 30, the present embodiment specifies the position and size of the weld metal zone 73 to be formed at and around the central portion 83.

Specifically, the present embodiment requires the following: as shown in FIG. 3, as viewed on a section of the spark member 70 and the ground electrode 30 taken along a plane which contains a centerline Q of the spark member 70, the weld metal zone 73 is formed within the range of the length D of the columnar portion 76 of the intermediate member 75 as measured along the direction orthogonal to the projecting direction of the spark member 70. The range of the length D is the range between opposite positions each located D/2 away from the centerline Q in the direction orthogonal to the projecting direction and is represented by A+B; i.e., the range of a portion of the bottom surface 80 encompassed in an imaginary plane which passes through the boundary between the columnar portion 76 and the flange portion 77 and extends in the projecting direction. Further, the present embodiment requires the following: with respect to the direction orthogonal to the projecting direction, the length d of the weld metal zone 73 is at least 10% of the length D of the columnar portion; i.e., the relation $d \geqq 0.1D$ is satisfied.

With respect to the direction orthogonal to the projecting direction, when the length d of the weld metal zone 73 present within the range A+B is less than 10%, a region where the weld metal zone 73 is not formed accounts for 90% or more within the range A+B. That is, the presence of the weld metal zone 73 is sparse at and around the central portion 83 of the bottom surface 80. Thus, the strength of joining the spark member 70 and the ground electrode 30 is effected primarily by the weld metal zone 73 formed at the peripheral portion 84 of the bottom surface 80. An oxide scale which progresses from the peripheral portion 84 side to the central portion 83 side is apt to progress rapidly at and around the central portion 83 where the weld metal zone 73 is sparsely present, resulting in potential easier occurrence of separation, cracking, or the like in the weld metal zone 73. This is apparent from the test result of Example 1 to be described later. By means of forming the weld metal zone 73 having the length d which is at least 10% of the length D, within the range of the length D of the columnar portion 76 as measured along the direction orthogonal to the projecting direction of the spark member 70 (range A+B), the spark member 70 and the ground electrode 30 can be joined with such a strength as to be able to endure a severe thermal test.

In order to further enhance the joining strength, desirably, at least a portion of the weld metal zone 73 is present within the range A between opposite positions each located D/4 away from the centerline Q in the direction orthogonal to the projecting direction. Further, it is good practice that the length d of the weld metal zone 73 is at least 40% of the length D; i.e., the relation $d \geqq 0.4D$ is satisfied. Through employment of these practices, the presence of the weld metal zone 73 can be rendered denser at and around the central portion 83 of the bottom surface 80. Since the progress of oxide scale can be restrained in the weld metal zone 73 formed at and around the central portion 83, the occurrence of separation, cracking, or the like can be restrained. This is also apparent from the test result of Example 1 to be described later. By means of specifying the length d of the weld metal zone 73 as mentioned above, the spark member 70 and the ground electrode 30 can be joined with such a strength as to be able to endure a far severer thermal test.

Incidentally, the spark member 70 disposed in the spark discharge gap GAP is exposed to high temperature in the course of spark discharges. In order to lower thermal load exerted on the noble metal member 71, it is desirable to quickly release heat received at the spark portion 70 toward the ground electrode 30 for prevention of accumulation of heat at the spark member 70. The weld metal zone 73 formed in the junction between the spark member 70 and the ground electrode 30 may deteriorate thermal conductivity to thereby hinder the release of heat from the intermediate member 75 to the ground electrode 30. Thus, for smooth flow of heat from the spark member 70 to the ground electrode 30, it is desirable to reduce the thickness of the weld metal zone 73 along the projecting direction of the spark member 70.

In the present embodiment, as mentioned previously, a projecting portion (not shown) is formed beforehand on the bottom surface 80 of the intermediate member 75. In the process of resistance welding, first, the projecting portion comes into contact with the inner surface 33 of the ground electrode 30. When the projecting portion melts in association with the progress of resistance welding, the weld metal zone 73 is formed and expands around the projecting portion. Since pressing the intermediate member 75 toward the ground electrode 30 continues in the course of formation of the weld metal zone 73, the thickness of the weld metal zone 73 can be rendered thin at the position where the projecting portion and the ground electrode 30 face each other. As a result, as viewed, after resistance welding, on the section of the region of joint between the spark member 70 and the ground electrode 30 (section which contains the centerline Q), a thick weld metal zone 73 is formed around the projection 78 which is a trace of the projecting portion, whereas a thin weld metal zone 73 is formed at the position of the projection 78. That is, there can be observed an irregularity or unevenness in thickness of the weld metal zone 73 (thickness in the projecting direction) at and around the central portion 83, which irregularity is produced by the projecting portion.

The thickness of a thinnest portion of the weld metal zone 73 formed within the range A is represented by t. T1 represents the thickness of a thickest portion of the weld metal zone 73 formed within opposite ranges B each between a position located D/4 away from the centerline Q in a direction orthogonal to the projecting direction and a corresponding position located D/2 away from the centerline Q in the direction orthogonal to the projecting direction. As mentioned above, since a trace of the projecting portion (not shown) of the intermediate member 75 is present in the weld metal zone 73 formed within the range A, the relation $t<T1$ is satisfied. That is, a thin portion of the weld metal zone 73 is present within the range A. Thus, heat can be smoothly conducted from the spark member 70 to the ground electrode 30, whereby resistance to spark-induced erosion of the noble metal member 71 can be enhanced. Also, since thermal load exerted on the weld metal zone 73 can be lowered, the progress of oxide scale in the weld metal zone can be restrained, whereby the strength of joining the spark member 70 and the ground electrode 30 can be enhanced. The relation $t \geqq T1$ is satisfied in the case where an irregularity in thickness is not produced by the projecting portion or the case where the projection 78 is located outside the range A. The relation t≧T1 hinders conduction of heat and is thus undesirable with respect to attainment of higher joining strength.

Specifically, as shown in FIG. 3, T2 represents the thickness of a thickest portion of the weld metal zone 73 formed within the range A, and the middle thickness (T2+t)/2 (represented by the dotted line in the drawing) of the thickness T2 and the thickness t of the thinnest portion is used as reference. A portion of the weld metal zone 73 having a thickness greater than the middle thickness (T2+t)/2 is taken as a first thick-layer portion L. Similarly, a portion of the weld metal zone 73 having a thickness greater than the middle thickness (T2+t)/2 and different from the first thick-layer portion L is taken as a second thick-layer portion N. A portion of the weld metal zone 73 having a thickness smaller than the middle thickness (T2+t)/2 is taken as a thin-layer portion M. At this time, in the present embodiment, within the range A, the first thick-layer portion L, the thin-layer portion M, and the second thick-layer portion N of the weld metal zone 73 are continuously arranged in this order in the direction orthogonal to the projecting direction.

In this manner, the weld metal zone 73 is reliably formed at and around the central portion 83 of the bottom surface 80 of the spark member 70, thereby enhancing the strength of joining the spark member 70 and the ground electrode 30. Further, by virtue of the weld metal zone 73 having the thin-layer portion M of small thickness, heat can be smoothly conducted from the spark member 70 to the ground electrode 30, whereby the resistance to spark-induced erosion of the noble metal member 71 can be enhanced. Since thermal load exerted on the weld metal zone 73 is lowered, the progress of oxide scale in the weld metal zone can be restrained, whereby the strength of joining the spark member 70 and the ground electrode 30 can be enhanced.

Needless to say, the present invention can be modified in various other forms. For example, the spark member 70 is joined to the inner surface 33 of the ground electrode 30 at a position corresponding to the distal end portion 31. The inner surface 33 is one surface of the ground electrode 30 and refers merely to a surface of the ground electrode 30 which faces the front end portion 22 of the center electrode 20. The inner surface 33 does not necessarily refer to an inwardly facing bent surface of the ground electrode 30. For example, the present invention can be applied to a spark plug in which the spark member 70 is joined to the end surface of the distal end portion 31 (i.e., the longitudinally distal end surface) of the ground electrode 30.

The thin-layer portion M is formed from the projection 78 which is a trace of a projecting portion (not shown) formed, before joining, on the bottom surface 80 of the intermediate member 75. However, the projecting portion may be formed on the ground electrode 30. The number of the projecting portions is not limited to one, but may be two or greater.

The columnar portion 76 of the intermediate member 75 assumes the form of a column extending along the projecting direction of the spark member 70. However, the diameter of the columnar portion 76 is not necessarily constant, and the shape of the columnar portion 76 is not limited to a circular column. For example, as in the case of an intermediate member 175 of a spark member 170 shown in FIG. 4, the outside diameter of a columnar portion 176 may reduce toward a noble metal member 171; i.e., as the distance from a flange portion 177 increases along the projecting direction. In this case, the maximal outside diameter of the columnar portion 176 may be set as the length D of the columnar portion 176 as measured in the direction orthogonal to the projecting direction of the spark portion 170 as viewed on the section of the spark member 170 which contains the centerline Q. Alternatively, the outside diameter of the columnar portion 176 as measured at the position of the boundary between the columnar portion 176 and the flange portion 177 may be set as the length D.

In the present embodiment, the inner surface 33 of the ground electrode 30 faces the center electrode 20, thereby forming the spark discharge gap GAP. Further, the inner surface 33 corresponds to "one surface" in the present invention and has the spark member 70 provided thereon. The "one surface" does not necessarily refer to an inwardly facing bent surface of the ground electrode 30, but may be an outer surface of the ground electrode 30 located at the position where the spark discharge gap GAP is formed between the center electrode 20 and the ground electrode 30. For example, there may be a spark plug 200 of FIG. 5 in which an electrode chip 190 joined to the center electrode 20 is elongated along the direction of the axis O, and a distal end portion 131 of a ground electrode 130 is bent toward the electrode chip 190. The spark discharge gap GAP is formed between the electrode chip 190 and a distal end surface 133 of the ground electrode 130. In this case, the end surface 133 of the ground electrode 130 which defines the spark discharge gap GAP is considered as the "one surface," and the spark member 70 may be provided on the end surface 133.

The following evaluation tests were conducted in order to confirm that the strength of joining the spark member 70 and the ground electrode 30 can be enhanced by means of the following: the weld metal zone 73 to be formed in the junction between the spark member 70 and the ground electrode 30 is formed at and around the central portion 83, and the weld metal zone 73 has the thin-layer portion M.

Example 1

First, an evaluation test was conducted in order to confirm the relation between the joining strength and the ratio of the length d of the weld metal zone 73 formed within the range of the length D of the columnar portion 76 of the intermediate member 75 (range A+B) to the length D. For this evaluation test, 130 spark plug test samples of 13 types (10 spark plugs per type) were prepared as follows: an intermediate member formed from INCONEL 601 (registered trademark) was joined to a noble metal member formed from Pt-10Ni to form a spark member, and the spark member was resistance-welded to a ground electrode formed from INCONEL 601. At this time, in order to form a weld metal zone having a desired size (a desired length along the projecting direction of the spark member) at a desired position for each of the sample types, the shape, size, position, etc. of the projecting portion of each of the intermediate members were adjusted as appropriate, and the conditions of resistance-welding between the spark member and the ground electrode were adjusted as appropriate.

Specifically, Sample 1 was formed such that the weld metal zone was not formed within the range A+B. Samples 2 to 13 were formed such that the length d of the weld metal zone formed within the range A+B was varied in a range of 0.05 mm to 0.45 mm inclusive. The length D of the columnar portion was 0.8 mm, and the ratio of the length d of the weld metal zone to the length D, d/D, was varied in a range of 0.06 to 0.56 (6% to 56%) inclusive. Samples 7, 9, 11, and 13 were formed such that at least a portion of the weld metal zone was formed within the range A. Other Samples 2 to 6, 8, 10, and 12 were formed such that the weld metal zone was not formed within the range A.

Five samples of each sample type were subjected to 3,000 cycles of a thermal test, each cycle consisting of heating of the spark member and the ground electrode with a burner, holding of heating at 1,000° C. for 2 minutes, and gradual cooling (natural cooling) for 1 minute. Similarly, the remaining five samples of each sample type were subjected to 3,000 cycles of a similar thermal test with a heating temperature of 1,050° C. in order to check to see if sufficient joining strength is maintained even under a severer thermal condition.

After the thermal test, the samples were cut along a plane which contained the centerline Q. By use of a magnifier, the weld metal zone in the junction between the spark member and the ground electrode was observed. The individual sections were observed for the weld metal zone; specifically, the length d of the weld metal zone along the direction orthogonal to the projecting direction of the spark metal was measured; whether or not separation in the weld metal zone had occurred was checked; and the length of oxide scale in the weld metal zone was measured. In each of the sample types, when even one of five samples showed the occurrence of separation, the sample type was evaluated as cc "failure" for the reason of a failure to provide desired joining strength. In each of the sample types, even though all of five samples were free from the occurrence of separation, if even one of five samples showed the progress of an oxide scale having a length of at least 50% of the length d of the weld metal zone, the sample type was evaluated as bb "good" for the reason that, even though the progress of oxide scale is observed, sufficient joining strength to maintain the state of joining the spark member and the ground electrode is exhibited. In each of the sample types, when all of five samples were free from the occurrence of separation, and no single sample showed the progress of an oxide scale having a length of at least 50% of the length d of the weld metal zone, the sample type was evaluated as aa "excellent" for the reason of exhibition of high joining strength. Table 1 showed the results of the evaluation test.

As shown in Table 1, in the thermal test which involved heating at 1,000° C., Samples 3 to 13 having a ratio of the length d of the weld metal zone of 0.10 (10%) or higher could sufficiently restrain the occurrence of separation and the progress of oxide scale, regardless of whether the weld metal zone was present or absent within the range A. However, in the thermal test which involved a severer thermal condition; i.e., heating at 1,050° C., Samples 3 to 8, 10, and 12 showed the progress of oxide scale. Even Sample 12 which enhanced joining strength through employment of a ratio of the length d of the weld metal zone of 0.50 (50%) failed to sufficiently restrain the progress of oxide scale. However, as is apparent from comparison between Sample 7 and Samples 9, 11, and 13, when at least a portion of the weld metal zone is formed within the range A, the occurrence of separation and the progress of oxide scale can be sufficiently restrained through employment of a ratio of the length d of the weld metal zone of 0.40 (40%) or higher.

Example 2

Next, an evaluation test was conducted in order to confirm the effect of the presence of a thin portion of the weld metal zone 73 within the range A. Similar to Example 1, for this evaluation test, spark plug test samples of 5 types were prepared as follows: an intermediate member formed from INCONEL 601 was joined to a noble metal member formed from Pt-10Ni to form a spark member, and the spark member was resistance-welded to a ground electrode formed from INCONEL 601 to form a spark discharge gap between the spark member and an electrode chip of It-5Pt of a center electrode. At this time, in order to form a weld metal zone having a desired size (a desired length along the projecting direction of the spark member) at a desired position for each of the sample types, the shape, size, position, etc. of the projecting portion of each of the intermediate members were

TABLE 1

| | Sample | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Length (dia.) of columnar portion D (mm) | 0.8 | | | | | | | | | | | | |
| Length d of weld metal zone d (mm) | 0 | 0.05 | 0.08 | 0.10 | 0.20 | 0.30 | 0.30 | 0.31 | 0.32 | 0.35 | 0.40 | | 0.45 |
| Ratio of length d of weld metal zone d/D | 0 | 0.06 | 0.10 | 0.13 | 0.25 | 0.38 | 0.375 | 0.39 | 0.40 | 0.44 | 0.50 | | 0.56 |
| Presence of weld metal zone within range A | No | No | No | No | No | No | Yes | No | Yes | No | Yes | No | yes |
| Occurrence of oxide scale or separation at 1,000° C. | cc | cc | aa | aa | aa | aa | aa | aa | aa | aa | aa | aa | aa |
| Occurrence of oxide scale or separation at 1,050° C. | cc | cc | bb | bb | bb | bb | bb | bb | aa | bb | aa | bb | aa |

adjusted as appropriate, and the conditions of resistance-welding between the spark member and the ground electrode were adjusted as appropriate.

Specifically, Sample 21 was formed such that the thickness t of a thinnest portion of the weld metal zone formed within the range A was near zero (e.g., less than 0.01 mm). Samples 22 to 25 were formed such that the thicknesses t of the weld metal zones 73 thereof were 0.02 mm, 0.04 mm, 0.06 mm, and 0.08 mm, respectively. The length D of a columnar portion was 0.8 mm. The thickness T1 of a thickest portion of the weld metal zone formed within the ranges B was varied as appropriate in a range of 0.14 mm to 0.20 mm inclusive such that the relation t<T1 was satisfied.

The samples were mounted to a 4-cylinder 2,000 cc test engine, and a running test was conducted at 5,000 rpm for 400 hours by use of an air-fuel mixture of an A/F ratio of 12.5 as fuel. The gap between the spark member of the ground electrode and the electrode chip of the center electrode was measured before and after the evaluation test for obtaining an increase in the gap stemming from subjection to the evaluation test for the individual samples. Table 2 shows the result of the evaluation test. In the column of Sample 21 in Table 2, the symbol "≅" appearing in the item "minimal thickness t" means that the value is not zero, but is near zero.

TABLE 2

| | Sample | | | | |
|---|---|---|---|---|---|
| | 21 | 22 | 23 | 24 | 25 |
| Length (dia.) of columnar portion D (mm) | | | 0.8 | | |
| Length d of weld metal zone d (mm) | 0.50 | 0.45 | 0.52 | 0.55 | 0.6 |
| Minimal thickness of weld metal zone formed within range A t (mm) | ≅0 | 0.02 | 0.04 | 0.06 | 0.08 |
| Maximal thickness of weld metal zone formed within ranges B T1 (mm) | 0.15 | 0.16 | 0.20 | 0.14 | 0.175 |
| Increase in gap between spark member and electrode chip (mm) | 0.09 | 0.1 | 0.1 | 0.12 | 0.13 |

As shown in Table 2, the larger the thickness t of a thinnest portion of the weld metal zone formed within the range A, the greater the gap between the spark member and the electrode chip. That is, the following has been confirmed: the thinner the weld metal zone, the smoother the conduction of heat from the spark member to the ground electrode, thereby enhancing resistance to spark-induced erosion through cooling of the noble metal member. This has revealed that the provision of a thin portion of the weld metal zone within the range A is desirable.

The invention claimed is:

1. A spark plug comprising:

a center electrode;

an insulator which has an axial hole extending along an axial direction and holds the center electrode in the axial hole;

a metallic shell which circumferentially surrounds and holds the insulator;

a ground electrode whose one end portion is joined to the metallic shell and which is bent such that one surface of the other end portion thereof faces a front end portion of the center electrode so as to form a spark discharge gap therebetween; and a spark member which is provided on the one surface of the other end portion of the ground electrode at a position corresponding to the spark discharge gap, projects from the one surface toward the center electrode, and is configured such that a noble metal member disposed on a side toward the center electrode with respect to a projecting direction thereof and an intermediate member disposed between the noble metal member and the ground electrode are joined to each other;

the intermediate member of the spark member having:

a columnar portion including a top surface joined to the noble metal member and extending in the projecting direction and a flange portion including a bottom surface joined to the ground electrode and assuming such a flange-like shape as to be radially expanded as compared with the columnar portion;

wherein the one surface of the ground electrode and the bottom surface of the intermediate member are resistance-welded to each other such that a weld metal zone is formed between the one surface and the bottom surface, and as viewed on a section of the intermediate member and the ground electrode taken along a plane which contains a centerline of the spark member extending along the projecting direction of the spark member, a relation d≧0.1D is satisfied, where d is a length occupied in a direction orthogonal to the projecting direction by a portion of the weld metal zone formed inside an imaginary plane which passes through a boundary between the columnar portion and the flange portion and extends along the projecting direction, and D is a length of the columnar portion as measured along a direction orthogonal to the projecting direction.

2. A spark plug according to claim 1, wherein:

as viewed on the section, the weld metal zone satisfies a relation d≧0.4D, and at least a portion of the weld metal zone is formed within a range between opposite positions each located D/4 away from the centerline in a direction orthogonal to the projecting direction.

3. A spark plug according to claim 1, wherein:

as viewed on the section, a relation t<T1 is satisfied, where t is a thickness of a thinnest portion of the weld metal zone as measured in the projecting direction within the range between opposite positions each located D/4 away from the centerline in the direction orthogonal to the projecting direction, and T1 is a thickness of a thickest portion of the weld metal zone as measured in the projecting direction within opposite ranges each between a position located D/4 away from the centerline in a direction orthogonal to the projecting direction and a corresponding position located D/2 away from the centerline in the direction orthogonal to the projecting direction.

4. A spark plug according to claim 3, wherein:

as viewed on the section, when T2 represents a thickness of a thickest portion of the weld metal zone formed within the range between opposite positions each located D/4 away from the centerline in the direction orthogonal to the projecting direction, a first thick-layer portion having a thickness greater than a middle thickness (T2+t)/2 of the thickness T2 and the thickness t, a thin-layer portion having a thickness smaller than the middle thickness (T2+t)/2, and a second thick-layer portion having a thickness greater than the middle thickness (T2+t)/2 and different from the first thick-layer portion are continuously arranged in this order in the direction orthogonal to the projecting direction, and a portion of the weld metal zone having the thickness t is present at the thin-layer portion.

5. A spark plug according to claim 2, wherein:

as viewed on the section, a relation t<T1 is satisfied, where t is a thickness of a thinnest portion of the weld metal zone as measured in the projecting direction within the range between opposite positions each located D/4 away from the centerline in the direction orthogonal to the projecting direction, and T1 is a thickness of a thickest portion of the weld metal zone as measured in the projecting direction within opposite ranges each between a position located D/4 away from the centerline in a direction orthogonal to the projecting direction and a corresponding position located D/2 away from the centerline in the direction orthogonal to the projecting direction.

6. A spark plug according to claim 5, wherein:

as viewed on the section, when T2 represents a thickness of a thickest portion of the weld metal zone formed within the range between opposite positions each located D/4 away from the centerline in the direction orthogonal to the projecting direction, a first thick-layer portion having a thickness greater than a middle thickness (T2+t)/2 of the thickness T2 and the thickness t, a thin-layer portion having a thickness smaller than the middle thickness (T2+t)/2, and a second thick-layer portion having a thickness greater than the middle thickness (T2+t)/2 and different from the first thick-layer portion are continuously arranged in this order in the direction orthogonal to the projecting direction, and a portion of the weld metal zone having the thickness t is present at the thin-layer portion.

7. A spark plug according to claim 1, wherein:

the ground electrode is formed from Ni or an alloy which predominantly contains Ni and the intermediate member is formed from an Ni alloy.

8. A spark plug according to claim 2, wherein:

the weld-zone metal has a dendritic structure, a marble-like structure, or a mixed structure thereof.

9. A spark plug according to claim 1, wherein the length d ranges from 0.05-0.6 mm.

* * * * *